United States Patent [19]

Shepherd, Jr.

[11] Patent Number: 4,654,158

[45] Date of Patent: Mar. 31, 1987

[54] VISCO-ELASTIC DETERGENT PREPARATION

[76] Inventor: Walter B. Shepherd, Jr., 971 Chevelle Dr., Akron, Ohio 44319

[21] Appl. No.: 779,110

[22] Filed: Sep. 23, 1985

[51] Int. Cl.[4] ..... C11D 17/00

[52] U.S. Cl. ..... 252/91; 252/174.17; 252/315.01; 252/548; 252/DIG. 5

[58] Field of Search ..... 252/91, 174.17, 548, 252/DIG. 5, 315.01

[56] References Cited

U.S. PATENT DOCUMENTS

| | | | |
|---|---|---|---|
| 4,130,449 | 12/1978 | Craig | 149/62 |
| 4,328,131 | 5/1982 | Carson, Jr. et al. | 252/542 |
| 4,414,144 | 11/1983 | Liebowitz et al. | 252/548 |
| 4,472,297 | 9/1984 | Bolich, Jr. et al. | 252/531 |
| 4,491,539 | 1/1985 | Hoskins et al. | 252/541 |
| 4,514,309 | 4/1985 | Wadhwa | 252/8.55 R |
| 4,561,997 | 12/1985 | Roehl | 252/522 A |

*Primary Examiner*—Paul Lieberman
*Assistant Examiner*—Hoa Van Le
*Attorney, Agent, or Firm*—Oldham, Oldham & Weber Co., L.P.A.

[57] ABSTRACT

A visco-elastic composition that is a cohesive mass consisting of an aqueous guar gum matrix constituting a continuous phase and having an aqueous detergent incorporated into the interstices of the continuous phase and constituting a discontinuous phase. The above-described composition is relatively dry to the touch and when kneaded mechanically or by hand releases the discontinuous detergent phase. The crosslinked guar gum matrix thus describes being of a nature so as to be destabilized by mildly acidic condition such as contact with skin causing the release of the soap solution.

7 Claims, No Drawings

VISCO-ELASTIC DETERGENT PREPARATION

TECHNICAL FIELD

This invention relates to a method of producing a visco-elastic, gel-like composition and to said composition. More particularly, this invention relates to an aqueous dispersion of a crosslinked hydroxyalkyl guar gum, and preferably hydroxylpropyl guar gum, and a detergent to yield a visco-elastic gel.

This invention, in a relatively broad aspect, relates to a visco-elastic gel like composition comprised of an aqueous, crosslinked guar gum matrix constituting a continuous phase and having an aqueous detergent solution incorporated into the interstices of the matrix that constitutes the discontinuous phase, said composition being crosslinked to develop the visco-elastic properties, usually by raising the pH to effect a crosslinking. The crosslinked guar gum is a reaction product preferably of a hydroxyalkyl guar gum where the alkyl radical thereof can have from 2 to 6 and preferably 3 carbon atoms, and the number of hydroxylalkyl radicals on the guar gum can be about 0.4 to 0.7 of the number of hydroxyl radicals theoretically possible in the guar gum. It is preferred that the gel-like composition contain 0.1 to 2.0 percent of a sequestering agent and 0.5 to 10 and preferably 1 to 8 percent of a fatty acid alkanol amide where the fatty acid has 11 to 20 and preferably 16 to 18 carbon atoms.

BACKGROUND ART

Heretofore, guar gum and its derivative has been used in varying concentrations, usually 1.0 percent by weight or less, to increase the viscosity of various detergent preparation. The guar gum, or its derivative produces a physical texture which is desirable in many cases, most commonly those involving cosmetic and personal care products. In such cases, the detergent preparation remains a flowable, viscous liquid and usually has a pH below 8.0 and may be classed as a liquid or at best a light gel.

DISCLOSURE OF INVENTION

It is an aspect of this invention to produce a novel visco-elastic, gel-like material having unique handling properties of being a cohesive, mechanically workable mass.

This invention is an aqueous crosslinked hydroxylakyl guar gum matrix containing a detergent base mixed therein. This visco-elastic composition, when mechanically worked or kneaded with the hands with or without the addition of water, leaves a detergent film on the skin which acts with water to perform a cleansing action. Thus, it offers a soap-like material having unique play value for a child and aids in getting children to wash.

BEST MODE FOR CARRYING OUT THE INVENTION

A visco-elastic, gel-like composition having a pH of about 7.0 to 8.5 or higher is produced by forming an aqueous dispersion of about 0.3 to 3.0 and preferably 0.5 to 2.5 percent and most preferably 1 to 2 percent by weight of a hydroxylalkyl guar gum where the alkyl radical contains 2 to 6 and preferably 3 carbon atoms and about 0.1 to 0.5 percent by weight boric acid or other crosslinking agent such as citric acid, and stirring said dispersion until the viscosity of said dispersion begins to increase rapidly, usually double or more, then adding to the dispersion 0 to 0.5 percent by weight of a sequestering agent such as ethylenediamine tetraacetate or other well known alkaline material softening agents to produce a crosslinked gel matrix as pH is increased.

A detergent mixture of suitable composition is then mixed into the crosslinked gel matrix via a suitable high shear mixer. This may or may not be done in a vacuum to avoid air entrapment. The detergent composition generally consists of an alkanolamide plus an anionic or amphoteric surfactant but may contain nonionic surfactants of the well known types. A preferred composition comprises from 0.25 to 5.0 percent fatty acid alkanolamide and from 2.0 to 40.0 percent anionic or amphoteric surfactant.

Other suitable alkali source surfactants may include sodium tripolyphosphate, caustic soda, caustic potash, monoethanol amine (MEA), triethanol amine (TEA), diethanol amine (DEA) and related amines for adjusting the pH to the range 7.0 to 10 or higher and preferably 7.0 to 8.5 pH.

Although other crosslinking agents such as citric acid can be used, boric acid is preferred as it gives a finished gel of better texture and elasticity. The crosslinking agents are usable in about 0.01 to 1.0 percent, with 0.01 to 0.5 percent being preferred.

The hydroxylalkyl guar gums useful in this invention act as a thickening agent and crosslink with the boric acid, or other crosslinking agents. The hydroxylalkyl group group contains from 2 to about 6 carbon atoms, but the one containing 3 carbon atoms is preferred. Usually about 0.4 to 1.0, and preferably 0.4 to 0.7, of the ester or hydroxyl groups of the guar gum are substituted with the hydroxylalkyl group.

Anionic and amphoteric detergents are well known. Representative examples of these useful in this preparation are the alkyl, alkylaryl or aryl sulfonates such as sodium lauryl sulfonate, sodium naphthalene sulfonates, sodium sulfosuccinates, betaine derivatives thereof; and dicarboxylic acid derivatives such as the "Miranols," and other such materials including potassium, ammonium and amine homologues of the above-listed materials. Alkali earth and/or amine soaps are also applicable as are taurates, sulfated fatty esters, sulfates and sulfonates of fatty alcohols and ethoxylates alkylphenols, sarcosine derivatives and carboxylated ethoxylates of fatty alcohols and fatty acids. The alkanolamide portion of the formulation preferably is taken from the group of 1:1 alkanolamides commonly known as "Superamides" and commonly used throughout the detergent field as foam stabilizers and enhancers. It is also noted that amine oxides may be substituted for the Superamide, if so desired.

The nature of this invention and its unique properties can be more readily seen by reference to the following illustrative and representative examples with all parts and percentages being of weight.

A series of visco-elastic, gel-like compositions were made using from about the lower to about the higher range of ingredients listed in Table I.

TABLE I

| Ingredients | Percent |
|---|---|
| Water | 50.5 to 90.0 |
| Hydroxylpropyl guar | 0.5 to 2.5 |
| Boric acid or other crosslinking agent | 0.1 to 0.5 |
| Sodium ethylenediaminetetraacetate | 0 to 0.5 |
| Coconut alkanolamide (1:1) | 0 to 5.0 |

TABLE I-continued

| Ingredients | Percent |
|---|---|
| Detergent Base | 2.0 to 40.0 |

The compositions were prepared by dispersing the hydroxylpropyl guar gum in water with moderate agitation. The boric acid or other crosslinking agent was added with increased agitation, and agitation is continued until hydration, as noted by the dramatic increase in viscosity, begins. The ethylenediaminetetraacetate or other sequestrant is added with sufficient potassium or sodium hydroxide to bring the pH above 7.0 but not above a preferred upper limit of about 8.5. The alkanolamide and surfactant base are then added and the composition is mixed in a high shear mixer until uniform. It should be appreciated that the mixing can occur exposed to the atmosphere or under a vacuum. The vacuum mixing excludes air incorporation and the formation of air mixtures of larger volume. A high shear mixer is particularly desired at this point. The resulting composition has an appearance of a gel and has a visco-elastic texture in that it is extremely "rubbery" to the touch. When gently pulled, the material stretches; and, when released, will "snap" back or recover its unstretched shape. The material is relatively dry to the touch, but when kneaded or handled for a period of time, the material leaves a detergent film on the hands. The visco-elastic texture of the gel can be increased by raising the pH up to about 8.4 or in rare instances as high as 10.0 or even above. This film washes away in water to leave the hands very clean.

The physical and chemical properties of this visco-elastic composition lends itself to a variety of novel applications. One such example is that because of the physically, relatively rigid form of this material, children are naturally curious about it. When handled or played with, the material deposits a discrete detergent film on the skin. When the hands are subsequently wetted, a copious foam is generated and the hands are left exceptionally clean. The composition will not adhere to clothing, furniture or hair and is non-staining and biodegradable. Hence, a child can use it as a play putty or dough-like material and then clean their hands by washing.

While in accordance with the patent statutes only the best mode and preferred embodiment of the invention has been illustrated and described in detail, it is to be understood that the invention is not limited thereto or thereby, but that the scope of the invention is defined by the appended claims.

What is claimed is:

1. A method of making a visco-elastic, gel-like composition comprising:
   forming an aqueous dispersion of about 0.5 to 2.5 percent of hydroxylalkyl guar gum, said alkyl group containing 2 to 6 carbon atoms, with stirring;
   adding to said dispersion about 0.1 to 0.5 percent of a crosslinking agent with stirring until the viscosity of said dispersion at least doubles;
   adding with stirring 0 to 0.5 percent of a sequestering agent, and increasing the pH of the composition until crosslinking occurs and then incorporating a discontinuous aqueous detergent phase into the crosslinked matrix comprising a solution containing about 0 to 10.0 percent of fatty acid alkanolamide and 2.0 to 40.0 percent of detergent base and mixing at high shear until a uniform gel-like composition forms.

2. The method of claim 1 wherein the crosslinking agent is boric acid.

3. The method of claim 1 wherein the sequestering agent is ethylenediaminetetraacetate.

4. The method of claim 1 wherein the detergent base is an anionic or an amphoteric detergent.

5. The method of claim 1 wherein the fatty acid of the fatty acid alkanolamide contains from 11 to 20 carbon atoms.

6. A method of making a visco-elastic, gel-like composition, comprising:
   forming an aqueous dispersion of about 0.5 to 2.5 percent of hydroxyalkyl guar gum, said alkyl group containing 2 to 6 carbon atoms, with stirring;
   adding to said dispersion about 0.1 to 0.5 percent of boric acid with stirring until the viscosity of said dispersion at least doubles; and
   adding with stirring 0 to 0.5 percent of ethylenediaminetetraacetate, about 0 to 5.0 percent of fatty acid amide and 2.0 to 40.0 percent of detergent base and mixing vigorously until uniform gel forms having a pH of 7.0 to 8.5.

7. The method of claim 1 wherein the sequestering agent is an alkylene tetracarboxylate where the acid yielding the carboxylate is selected from those having about 2 to 5 carbon atoms and the alkylene radical contains from about 2 to 4 carbon atoms.

* * * * *